United States Patent [19]

Hedlund

[11] Patent Number: 4,705,321

[45] Date of Patent: Nov. 10, 1987

[54] DEVICE FOR SUPPLYING FLUID TO A TOOL FOR BREAKING HARD MATERIAL

[75] Inventor: Jan-Gunnar Hedlund, Sandviken, Sweden

[73] Assignee: Santrade Limited, Lucerne, Switzerland

[21] Appl. No.: 872,651

[22] Filed: Jun. 10, 1986

[30] Foreign Application Priority Data

Jun. 13, 1985 [SE] Sweden ..... 8502936

[51] Int. Cl.[4] ..... F21B 10/18; E21C 35/22

[52] U.S. Cl. ..... 299/81

[58] Field of Search ..... 299/81, 17, 12; 175/393

[56] References Cited

U.S. PATENT DOCUMENTS

| | | | |
|---|---|---|---|
| 4,070,064 | 1/1978 | Cobb et al. | 299/81 |
| 4,154,482 | 5/1979 | Farman | 299/81 |
| 4,437,707 | 3/1984 | Best et al. | 299/81 |
| 4,456,306 | 6/1984 | Wrulich et al. | 299/81 |
| 4,488,759 | 12/1984 | Bergqvist | 299/81 |
| 4,573,744 | 3/1986 | Clemmow et al. | 299/81 |
| 4,585,275 | 4/1986 | Wrulich et al. | 299/81 |

FOREIGN PATENT DOCUMENTS

| | | | |
|---|---|---|---|
| 010534 | 4/1980 | European Pat. Off. . | |
| 1042019 | 9/1966 | United Kingdom | 299/81 |
| 2019920 | 11/1979 | United Kingdom | 299/81 |

*Primary Examiner*—James A. Leppink
*Assistant Examiner*—David J. Bagnell
*Attorney, Agent, or Firm*—Burns, Doane, Swecker & Mathis

[57] ABSTRACT

The invention relates to a device for supplying fluid to a tool for breaking solid material, said tool being mounted in a holder, and that a nozzle is arranged in or in connection to the tool. A connection element for fluid transmission is arranged to bridge the opposing contact surfaces on the holder and the machine part in such a way that fluid is prevented to enter between said contact surfaces.

11 Claims, 4 Drawing Figures

DEVICE FOR SUPPLYING FLUID TO A TOOL FOR BREAKING HARD MATERIAL

BACKGROUND OF THE INVENTION

The present invention relates to a device for supplying fluid to a tool for breaking hard material, e.g. coal, said tool being mounted in a holder, and that a nozzle is arranged in or in connection to the tool, and that fluid is arranged to be supplied to the nozzle via a first channel in the holder and a second channel in a machine part, e.g. a shearer drum, supporting the holder, said second channel communicating with said first channel.

In devices of this kind fluid is supplied in order to, on one hand, cool the tool and the rock thus reducing the risk for ignition that can cause fire or gas explosion and on the other hand, to limit the presence of dust. High fluid pressures can also assist in breaking the material. Devices of that type are described in German Pat. No. 3307895 and EP-A-10534.

In these known devices fluid can enter between the holder and the machine part. This means high forces on the welded joint between the holder and the machine part and it also means risk for corrosive damages on the contact surfaces between the holder and the machine part.

An aim of the present invention therefore is to provide a device that prevents fluid to enter between the contact surfaces between the holder and the machine part.

Another aim of the present invention is to provide a fluid transmission that imposes no longitudinal force on the tool.

THE DRAWINGS

The invention is described more in detail in the following, reference being made to the enclosed drawings disclosing different embodiments as way of example. These are only intended to illustrate the invention that can be modified within the scope of the claims.

In the drawings FIG. 1 discloses a side view, partly in section, of an embodiment of a device according to the invention.

FIG. 2 discloses a side view, partly in section, of another embodiment of a device according to the invention.

FIG. 3 discloses a side view, partly in section, of a further embodiment of a device according to the invention.

FIG. 4 discloses a side view, partly in section, of still a further embodiment of a device according to the invention.

In the drawings the details that correspond to each other at the different embodiments have been given the same reference numeral.

DESCRIPTION OF PREFERRED EMBODIMENTS OF THE INVENTION

Figure 1:
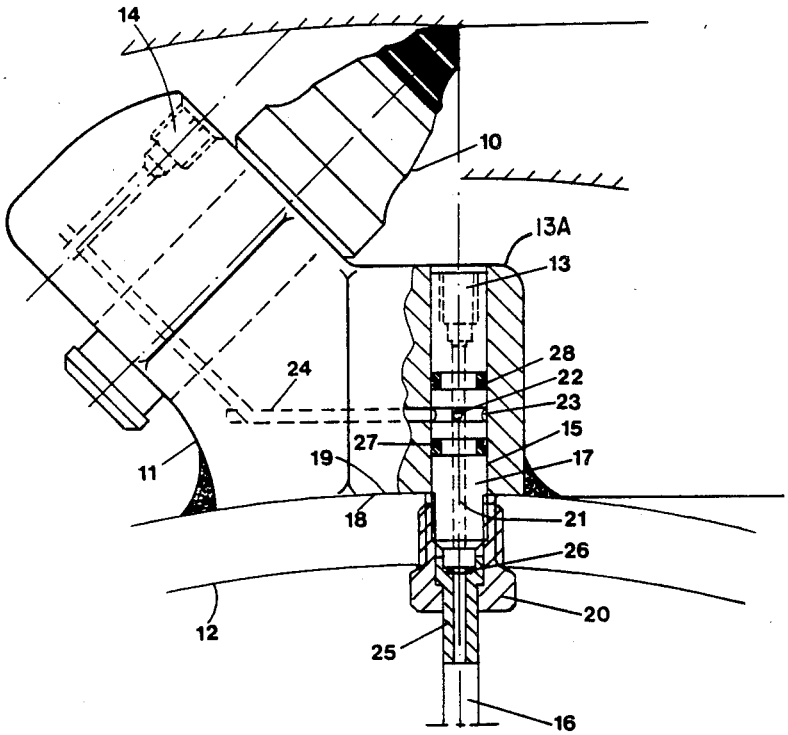

In the embodiment disclosed in FIG. 1 a tool or cutting member 10 for breaking solid material is mounted in a holder 11, the tool and holder defining a tool means. The holder 11 is welded to a part 12 of a machine for breaking solid material, e.g. a shearer head or a shearer drum as is shown in European Application No. 10534. Cooperating with 10 are nozzles 13, 14 which are arranged in the holder 11. The nozzles 13, 14 are directed in such a way that a fluid spray emerging from said nozzles is directed somewhat in front of and behind the tip of the tool 10.

In the holder 11 a channel 15 is provided, said channel communicating with a channel 16 in the machine part 12 to defne a fluid passage. A connection element 17 supports the nozzle 13, said connection element 17 being arranged in the channels 15, 16 in such a way that it bridges the opposed surfaces 18, 19 on the holder 11 and the machine part 12 respectively, said surfaces 18, 19 surrounding said channels 15, 16 and defining an interface between the holder and machine part.

The connection element 17 is screwed into a nut 20 that is screwed into the machine part 12. The connection element 17 is thus via threads indirectly connected to the machine part 12.

The connection element 17 is provided with a through channel 21 and a transverse channel 22 or outlet communicating with said through channel 21. The transverse channel 22 also communicates with an external, annular space 23 on the connection element 17. Fluid from the channel 16 is thus led to the nozzle 13 via the channel 21 and to the nozzle 14 via the channels 21, 22, the annular space 23 and a channel 24 in the holder 11.

Between the inner end surface of the connection element 17 and an annular surface on a coupling element 25, located in the nut 20, a sealing ring 26 is provided, said annular surface opposing said end surface. The sealing ring 26 prevents fluid in the channel 16 from traveling to a position between the surfaces 18, 19. On both sides of the annular space 23 sealing rings 27, 28 are provided, said sealing ring 27 preventing fluid outside the holder from reaching the area between the surfaces 18, 19.

The connection element 17 is removable from the outside, e.g. through an outer face 13A of the holder, by means of an Allen key that is inserted into the outlet of the channel or boring 15, said outlet being located on the outside of the holder 11. The sealing between the connection element 17 and the machine part 12 can be carried out in different ways. Thus instead of the disclosed O-ring 26, a copper ring or a conical sealing surface be used.

The tool 10 is in a known way rotatably mounted in the holder 11. In order to restrict the supplied amount of fluid, said fluid is preferably being supplied only when the tool is axially loaded during work. This can be done by sensing the force that acts on the tool, e.g. by strain gauges, such that a control signal generated by these strain gauges activates a control valve related to the nozzles 13, 14.

Figure 2:
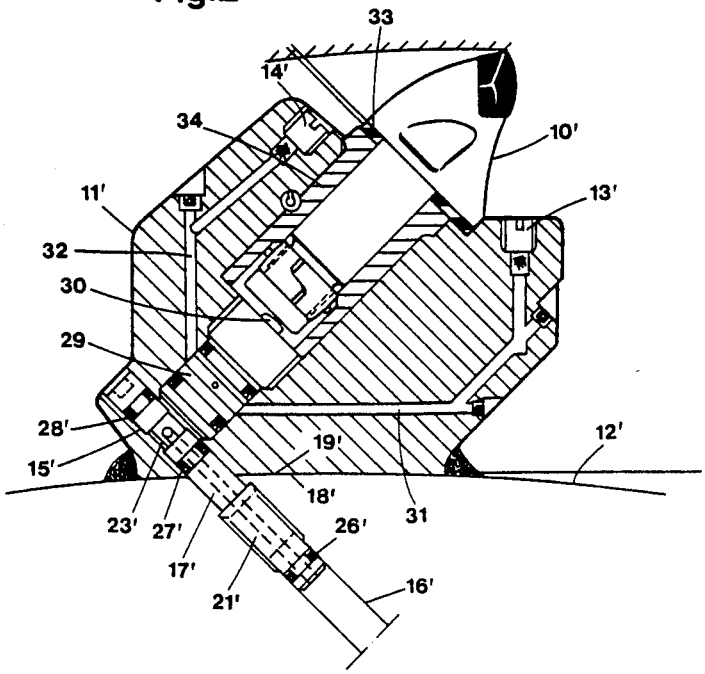

In the embodiment of FIG. 2 the tool 10' is mounted axially movable in the holder 11'. The fluid from the channel 16' is via the channel 21' in the connection element 17' led to the annular space 23' communicating with a valve 29, e.g. of the type disclosed in Swedish Patent 8201491. When the tool 10' is displaced axially rearwards the valve 29 is shifted by its slide 30 and the fluid is flowing via the channels 31, 32 to the nozzles 13', 14'. A rubber ring 33 is provided between the tool 10' and a sleeve 34 in the holder 11', said sleeve 34 supporting said tool 10'. The aim of the rubber ring 33 is to keep out loose particles which could hinder or prevent the axial displacement of the tool 10'.

The sealing means related to the connection element 17' comprises a sealing ring 26' located in an annular groove in the connection element, sealing rings 27', 28' arranged on both sides of the annular space 23'.

Figure 3:
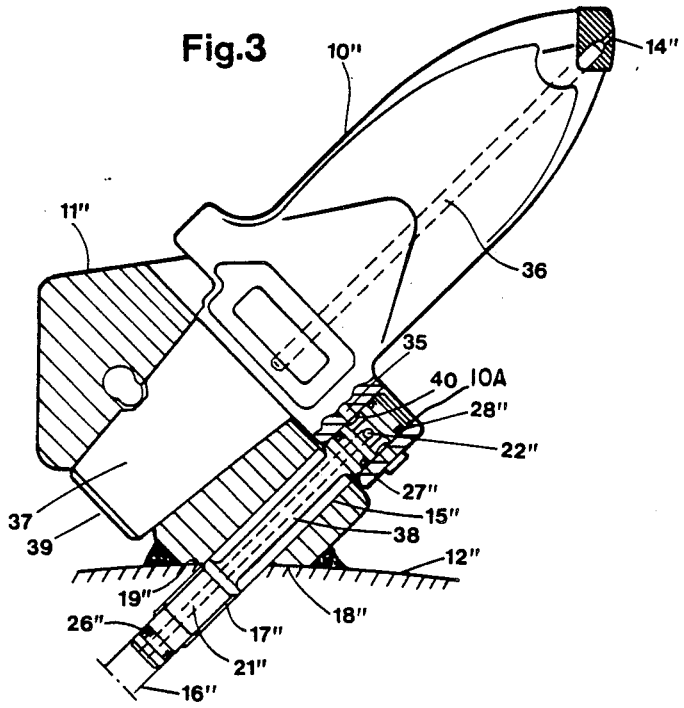

In the embodiment disclosed in FIG. 3 the tool 10'' has a conical shaft 37 that is secured in a corresponding conical boring in the holder 11''. The fluid from the channel 16'' flows via the channels 21'', 22'' in the connection element 17'' into a transverse channel 35 in the tool 10'' and further via a longitudinal channel 36 to a nozzle 14'' arranged in the tool. The sealing means related to the connection element 17'' comprises a sealing ring 26'' arranged in an annular groove in the connection element 17'', and also a pair of sealing rings 27'', 28'' arranged on both sides of the transverse channel 22''.

The front portion of the connection element 17'' is designed to be received in a boring of the tool 10''. The channel 22'' and the sealing rings 27'', 28'' are arranged parallel to this boring. The connection element 17'' is arranged to have an elongation in the longitudinal direction of the tool 10''.

Since the passage for transmitting fluid from the machine part 12'' to the tool bypasses the interface between the tool 10'' and the holder 11'', a deterioration of that interface, e.g., by wear, will not affect the function of the passage or vice versa. Due to wear or different tolerances in the conical connection between the tool 10'' and the holder 11'' the tool assumes different positions; adapt to these variations in position the connection element 17'' comprises an elastically flexible intermediate section 38.

As observed earlier high fluid pressures can assist in breaking the material. In known tools having internal fluid channels these high pressures, up to about 700 bars, will cause great axial forces on the tool, which forces can loosen or at least detoriate the connection between the tool and the holder. In the embodiment of FIG. 3 the boring in the tool 10'' for the connection element 17'' is essentially parallel to the longitudinal axis 39 of the tool 10''. Consequently the surface 40 of the tool 10'', against which the fluid acts extends parallel to the tool longitudinal axis. Hence, the fluid cannot exert longitudinally directed forces upon the tool 10'''.

Figure 4:
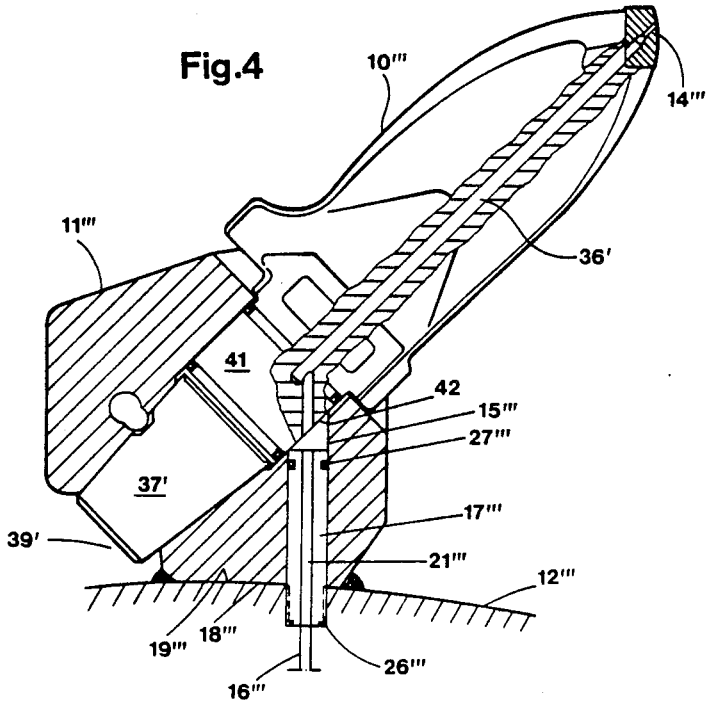

In the embodiment of FIG. 4 the tool 10''' is in a similar way as the tool 10'' in FIG. 3 designed with a through channel 36' for fluid.

The shaft of the tool 10''' comprises besides a conical portion 37' also a cylindrical portion 41, said portions being inserted in and secured to corresponding conical and cylindrical borings in the holder 11'''. A connection element 17''' is screwed into and secured to the machine part 12'''. Sealing rings 26''', 27''' are positioned between the connection element 17''' on the one hand, and the machine part 12''' and holder 11''', respectively, on the other hand to isolate the surfaces 18''', 19''' from the fluid in the channel 16'''.

Fluid from the channel 16''' flows via the channel 21''' in the connection element 17''' and the channel 36' in the tool 10''' to the nozzle 14'''. The channel 36' is arranged to emerge into the outside surface 42 of the cylindrical portion 41. Due to the fact that the surface 42 is essentially parallel to the longitudinal axis 39' of the tool 10''' also in this embodiment the fluid will not impart any longitudinal forces to the tool.

I claim:

1. Apparatus for breaking solid material comprising:

a machine part including a first surface, tool means mounted on said machine part and including:

a holder having a second surface opposing said first surface to define an interface between said machine part and said holder, a cutting member mounted on said holder, and at least one fluid nozzle mounted in said tool means for directing fluid toward material being cut;

a fluid conducting passage for conducting fluid from said machine part to said nozzle, said passage including:

a first channel in said tool means, and a second channel in said machine part, said first and second channels communicating with one another at said interface, a connection element disposed in said passage at said interface and extending into said first and second channels to bridge said first and second surfaces, said connection element including a conduit for conducting said fluid from said second channel to said first channel, and sealing means for creating a fluid seal between said connection element and walls of said first and seconds channels to prevent fluid in said passage from reaching said interface, said first channel extending to an outer face of said tool means and being of sufficiently large cross-section to permit said connection element to be removed and inserted through said outer face while said holder remains attached to said machine part.

2. Apparatus according to claim 1, wherein said outer face of said tool means through which said connection element is removable is defined by said holder.

3. Apparatus according to claim 1, wherein said first channel extends through both said holder and said cutting member, said outer face of said tool means through which said connection member being removable is defined by said cutting member.

4. Apparatus according to claim 3, wherein said connection element includes an elastically flexible section enabling said connection element to compensate for shifting of said cutting member relative to said holder.

5. Apparatus according to claim 3, wherein said cutting member and said holder define an additional interface therebetween, said connection element including a fluid outlet disposed within the portion of said first channel situated in said cutting member, said sealing means including a seal disposed in said portion of said first channel between said outlet and said additional interface.

6. Apparatus according to claim 5, wherein said sealing means includes a seal disposed in said first channel between said outlet and said outer face of said tool means.

7. Apparatus according to claim 1, wherein said connection element is attached to said machine part.

8. Apparatus according to claim 7, wherein said connection element is threadedly connected to said machine part.

9. Apparatus according to claim 1, wherein said sealing means comprises separate seal members carried by said connection element.

10. Apparatus according to claim 9, wherein said seal members comprise elastic O-rings.

11. Apparatus according to claim 1, wherein said nozzle is disposed in said cutting member, said first channel including a portion extending from said holder into said cutting member through a wall of said cutting member oriented substantially parallel to a longitudinal axis of said cutting member.

* * * * *